US005950477A

United States Patent [19]

Matsunaga

[11] Patent Number: 5,950,477

[45] Date of Patent: Sep. 14, 1999

[54] ROLL FORMING MACHINE AND METHOD FOR CHANGING SIDE ROLL STANDS

[75] Inventor: Douglas S. Matsunaga, Mettawa, Ill.

[73] Assignee: Braner USA, Inc., Schiller Park, Ill.

[21] Appl. No.: 08/914,741

[22] Filed: Aug. 19, 1997

[51] Int. Cl.[6] ..... B21B 31/08

[52] U.S. Cl. ..... 72/239

[58] Field of Search ..... 72/238, 239, 181, 72/176, 201, 226

[56] References Cited

U.S. PATENT DOCUMENTS

| | | | |
|---|---|---|---|
| 5,050,418 | 9/1991 | Grotepass | 72/239 |
| 5,450,740 | 9/1995 | Lovinggood et al. | 72/182 |
| 5,461,896 | 10/1995 | Abbey, III et al. | 72/239 |
| 5,600,988 | 2/1997 | Abbey, III et al. | 72/239 |
| 5,823,036 | 10/1998 | Matsunaga | 72/239 |

FOREIGN PATENT DOCUMENTS

WO 94 16839 8/1994 WIPO .

*Primary Examiner*—Rodney Butler
*Attorney, Agent, or Firm*—Baker & Daniels

[57] ABSTRACT

A roll forming machine includes side roll stands which are changed by use of a cart and set up fixture which are movable parallel to the pass line through the stands. When a side roll stand is to be changed, a changing cart is moved into position such that rails on the cart are aligned with rails on the fixed support supporting the side roll stand. The side roll stand is moved off of the fixed support and onto the cart, and then moved from the cart into an empty station on a set up fixture. A retooled stand is moved from another station on the set up fixture onto the cart and then from the cart back onto the fixed support. Accordingly, time to effect changeover of a stand is reduced substantially from prior art methods, and no heavy equipment, such as a crane, is required.

12 Claims, 3 Drawing Sheets

ROLL FORMING MACHINE AND METHOD FOR CHANGING SIDE ROLL STANDS

This invention relates to a roll forming machine for forming flat sheet stock into tubing and to a method for changing side rollers of such roll forming machines.

Roll forming machines, also known as tube mills, include multiple mill stands each having rolls of a different design used to progressively form flat sheet stock into a tube. The mill stands are of two basic different types. One type of mill stand uses "pinch" rolls mounted on horizontal arbors, which are driven by electric motors. These pinch rollers are engaged with the top and bottom of the sheet stock being fed through the mill. The other type of stand includes "side" rolls, which are generally not driven and are mounted on vertically extending arbors. The side rolls engage the side of the tube to "push" sideways on the still open tube as it is being formed. In either case, different rolls must be used for each different type and size of tube to be manufactured. Accordingly, it is often necessary to shut down the line and retool the tube mills. Several hours are often required for a complete retool of the tube mill. The present invention concerns a method and apparatus for more easily accomplishing retooling of the vertically mounted side rollers. It will, of course, be appreciated that the side rollers must be changed every time that the pinch rollers are changed because the profile of the tooling is for a specific size and type of tube.

In the prior art, the side roll stands were bolted into place on a fixed support. These stands were changed by unbolting them, hooking them (one at a time) to an overhead crane, using the overhead crane to transport them to a set up area, hooking the replacement side roll stands with the new tooling onto the crane, transferring the stand back to the line, and rebolting it to the base. It will be readily appreciated that this is a difficult and time consuming operation, with much lost production time whenever the tube mill needs to be retooled.

According to the invention, each of the side roll stands are mounted on a fixed support via rails which extend transversely to the material pass line. A changing cart is mounted on rails extending generally parallel to the material pass line so that the cart can travel along one side of the roll forming machine. Accordingly, when one of the side roller stands is to be changed, the side roll stand slides off the fixed support and onto the cart. The cart can then be used to transfer the side roll stand to one station of a changing fixture, which is equipped with parallel sets of rails to both receive side roller stands that must be retooled, and to store stands to replace stands on the tube line. The stand that is to be installed on the tube line is then transferred to the cart and from the cart to the tube line. Accordingly, no overhead crane is required, and the time required to change a side roll is reduced by 80%. Accordingly, down time for changeover is substantially reduced, and production can be increased.

These and other advantages of the present invention will become apparent from the following description, with reference to the accompanying drawings, in which.

Figure 1:
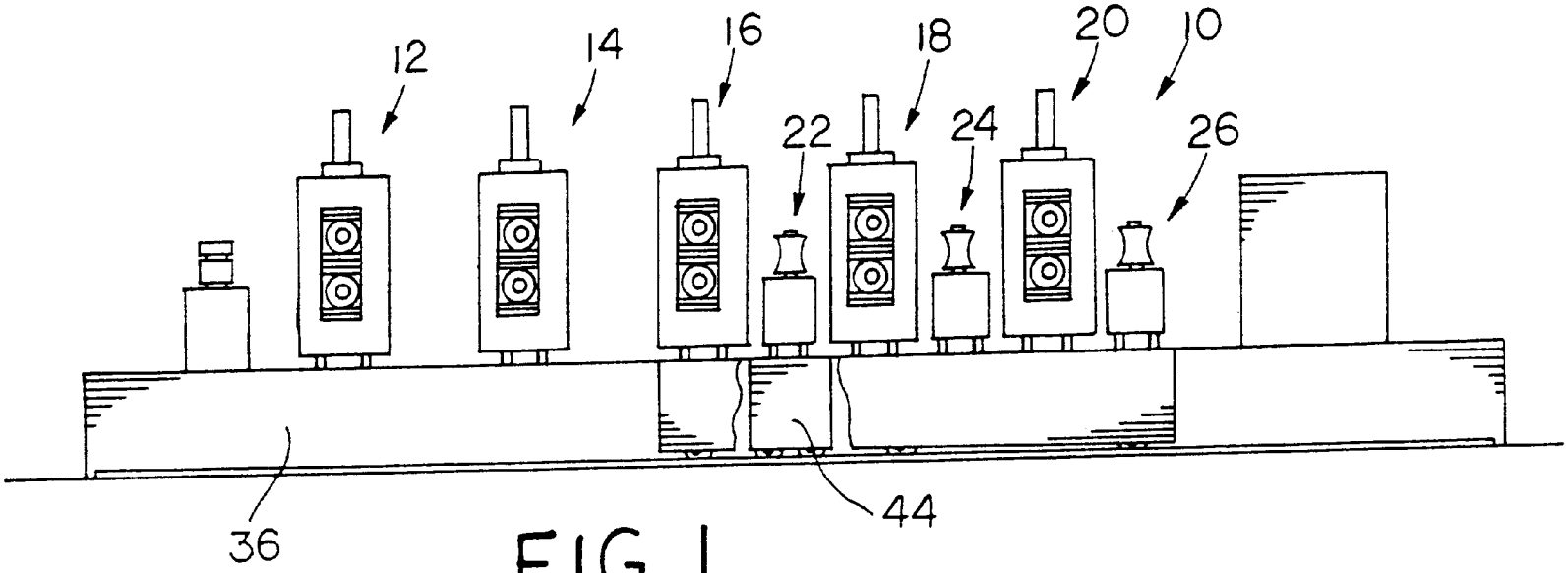
FIG. 1 is a side elevational view of a portion of a roll forming machine or tube mill made pursuant the teachings of the present invention, with a portion of the changing fixture used therein broken away to show the changing cart.
Figure 6:
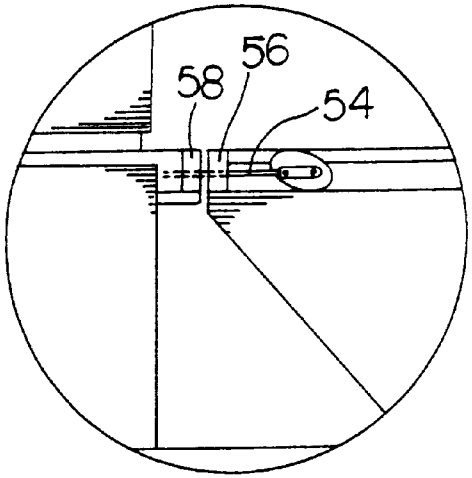
FIG. 6 is an enlargement of the circumscribed portion of FIG. 3.
Figure 2:
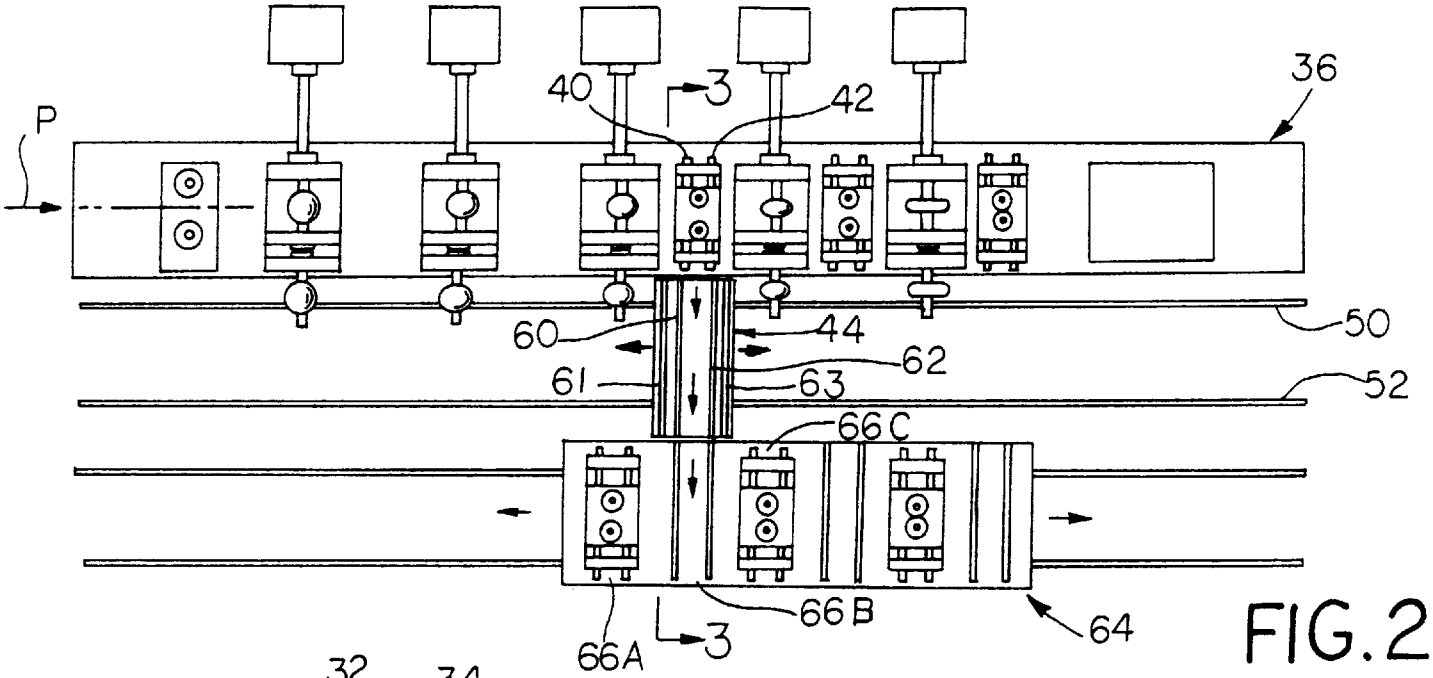
FIG. 2 is a top plan view of the roll forming machine illustrated in FIG. 1.
Figure 3:
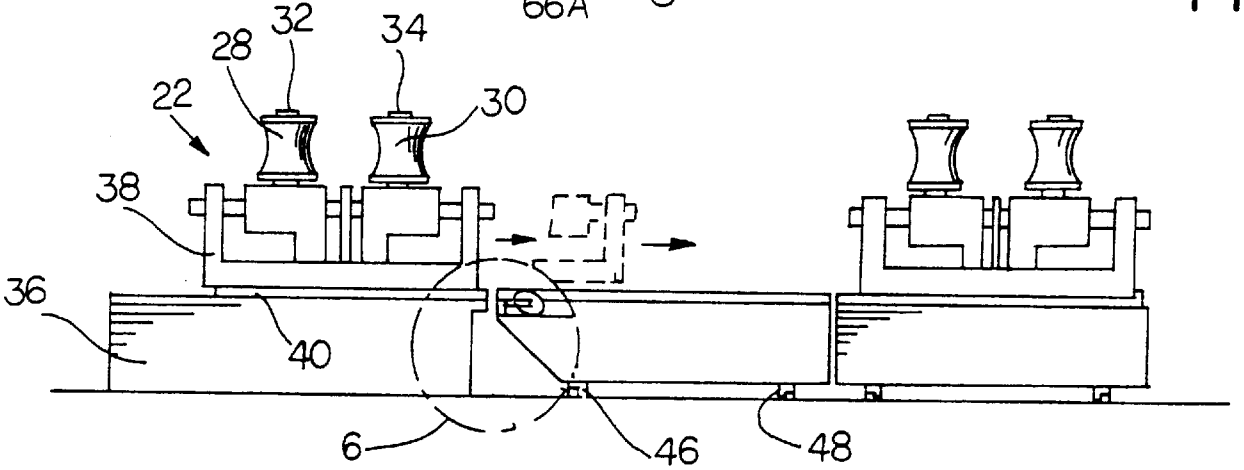
FIG. 3 is cross sectional view taken substantially along lines 3—3 of FIG. 2.
Figure 4:
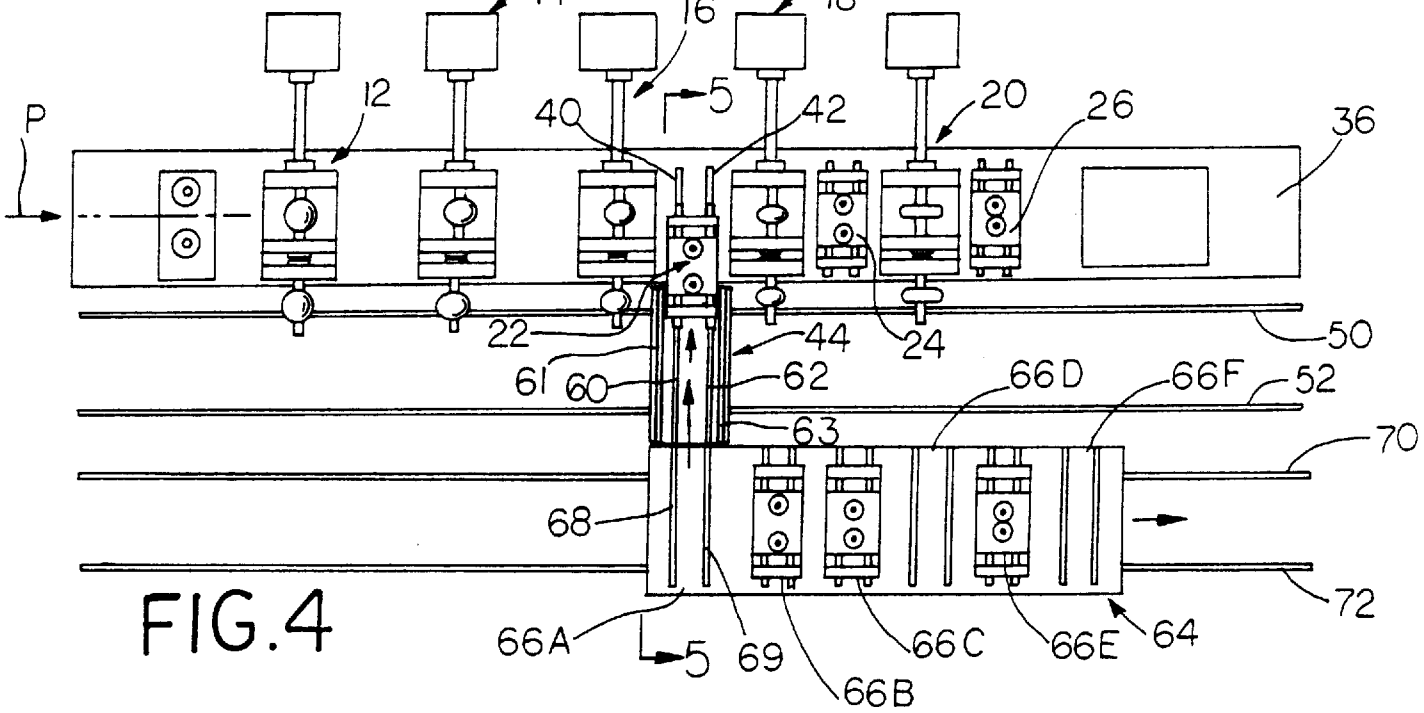
FIG. 4 is a view similar to FIG. 2, but illustrating the manner in which replacement side roller stands are installed in the tube line.
Figure 5:
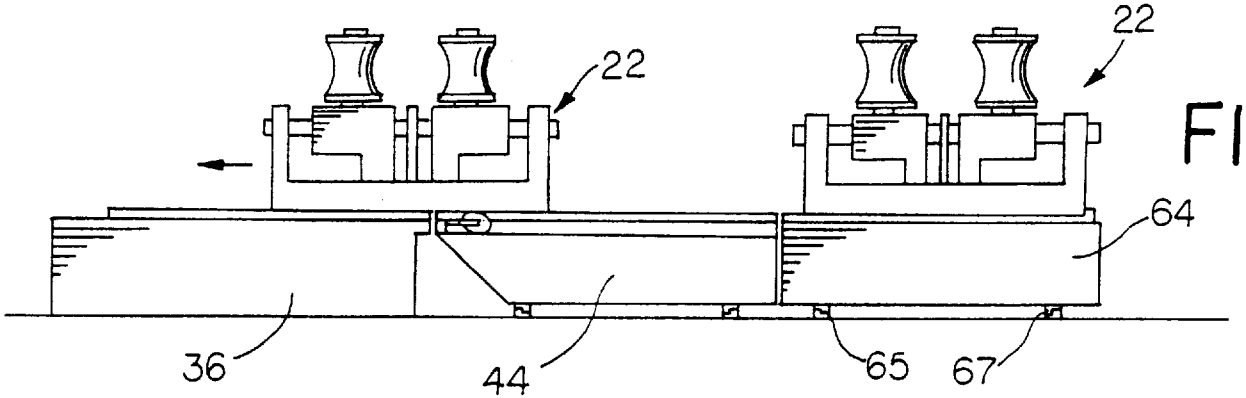
FIG. 5 is cross sectional view taken substantially along lines 5—5 of FIG. 4.

Referring now to the drawings, reference numeral 10 generally designates a roll forming machine or tube mill line, which is commonly used in making welded tubes from flat sheet metal stock. As shown in FIGS. 1, 2 and 4, tube mills typically include mill stands 12, 14, 16, 18 and 20, which carry horizontal "pinch" rollers and side roll stand 22, 24, 26, each of which include a pair of side rollers 28, 30, which are journaled for rotation about generally vertical shafts 32, 34. Together, the mill stands 12–26 define a material pass line P along which sheet stock is passed which is gradually formed into a tubular shape by the mill stands as the sheet stock passes through the roll forming machine or tube mill 10. The general manner in which sheet stock is formed into welded tubes is old and well known to those schooled in the art, the detailed process will not be described in detail herein. All of the mill stands 12–26 are mounted on a common fixed support or base generally indicated by the numeral 36. Each of the side roll stands 22–26 further include a mount 38 which support the shafts 32, 34 and the rollers 28–30. The mounts 38 are conventional, except that instead of being bolted directly to the fixed support 36, the mounts 38 are provided with glides or rollers (not shown) which slidably support the mounts 38 on substantially parallel rails 40, 42 which extend transversely to the material pass line P. When the side roll stands 22–26 are installed on the pass line P and production is taking place, a suitable lock or latch (not shown) is provided to lock the mount 38 in place, the locks or latches being easily releasable to permit the mounts 38 to slide on the rails 40, 42 during changeover.

According to the invention, a changing cart generally indicated by the numeral 44 is provided with rollers or glides 46 that support the cart 44 for movement along base parallel rails 50, 52 along the edge of the fixed support 36 and substantially parallel to the material pass line P. Accordingly, the rails 50,52 restrain the cart 44 for movement in a direction parallel to the material pass line. When the cart 44 is moved into position adjacent one of the side roll stands, such as side roll stand 22, and which is to be changed, it is locked in place by use of a pin 54 which extends through apertures and an ear 56 on the cart 44 and another ear 58 on the fixed support 36. Accordingly, with the pin in place cart 44 cannot be moved relative to the fixed support 36. The cart 44 is provided with a pair of inner rails 60, 62 which are spaced substantially the same distance apart as are the rails 40, 42 that support the side roll stand 22 on the fixed support 36. The cart may also be provided with a pair of outer rails 61, 63, which receive the "pinch" roll stands 12–20 when the latter the "pinch" role stands 12–20 are rotated to bring inactive rollers into the pass line P, as disclosed in U.S. Pat. No. 5,450,740 and in co-pending U.S. patent application Ser. No. 08/914,741, filed on Aug. 19, 1997. Accordingly, the same cart may be used to change both the side roll stands and the pinch roll stands.

The cart 44 is used to transfer the side roll stands 22, 24 or 26 to a set up fixture generally indicated by the numeral 64. The set up fixture 64 includes rollers or glides 65, 67 that slidably engage spaced parallel rails 70, 72 that extend substantially parallel to the material pass line P. Accordingly, set up fixture 64 can be moved relative to fixed support 36 and the cart 44. Set up fixture 64 includes any number of stations 66A–66F each of the stations 66A-66F consisting of spaced parallel rails 68, 69, which have the same spacing as the rails 60, 62 on the cart 44. A pin (not shown) similar to pin 54 is also provided to lock the track 44 to the set up fixture 64. Although the set up fixture 64 is illustrated mounted for movement on the rails 70, 72, the set up fixture may be stationary. The cart 44 would then have to be moved between the stations 66A–66F.

In operation, when one of the side roll stands 22, 24 or 26 is to be changed, the cart 44 is brought into position in which the rails 60, 62 of the cart register with the rails 40 and 42 on the fixed support 36 supporting the stand 22 to be changed. The cart is then locked in place, the stand is released, and the stand is moved off of the fixed support 36 and onto the cart 44. The set up fixture 64, if it has not already been done so, is brought into the position in which the cart 44 registers with an empty station, such as the station 66B in FIG. 2. Accordingly, the stand 22 is moved off of the fixed support 36 and onto the cart 44, and off of the cart 44 and into station 66B of the set up fixture 64. Set up fixture 64 is then moved so that the desired replacement stand being stored in one of the stations of the set up fixture 64, such as, the stand in station 66A, is brought into registry with the cart 44. A replacement side roll stand is then moved out of station 66A and onto the cart 44, and then from the cart 44 onto the fixed support 36, as illustrated in FIG. 4. Accordingly, the formerly active stand, which is now in station 66B of set up fixture 64, may be inspected, repaired or retooled while stored on set up fixture 64 prior to being again installed on the fixed support 36 when tooling is again changed. After a changeover of the stand 22, the cart 44 and set up fixture 64 can be moved to change the other side roll stands 24 and 26 in the same way. Accordingly, changeover of the side roll stand is reduced significantly and no crane is required.

As discussed above, the set up fixture 64 may be stationary. Accordingly, after the stand 22 is moved onto the cart, the cart is released and moved into an empty position in the set up fixture. The stand is again moved to another station, where a replacement stand is moved onto the cart 44. The cart 44 is then moved into a position where the replacement stand can be moved back onto the fixed support.

What is claimed:

1. A roll forming machine comprising multiple mill stands having components defining a material pass line through the mill stands, a fixed support supporting said components, slidably mounting means slidably mounting said components on said fixed support for movement transverse to said pass line, a changing cart mounted for movement parallel to said material pass line along a side of said fixed support, a changing fixture having multiple stations for receiving one of said components, each of said stations including station supports for slidably supporting one of said components, said changing cart having sliding support means compatible with the slidably mounting means and the station supports to permit a mill stand to be moved between said fixed support, said cart, and one of the stations of said changing fixture.

2. Roll forming machine as claimed in claim 1, wherein said slidably mounting means includes a first set of rails slidably supporting said components.

3. Roll forming machine as claimed in claim 1, wherein said sliding support means includes a set of rails which on the cart which register with another set of rails in one of the stations when the cart is moved into a changing position adjacent to one of the stations.

4. Roll forming machine as claimed in claim 1, wherein said changing fixture is movable relative to the fixed support and said cart in a direction parallel to the material pass line.

5. Roll forming machine as claimed in claim 1, wherein said cart is mounted for movement along rails extending parallel to the material to the material pass line.

6. Roll forming machine as claimed in claim 1, wherein said components include side roller assemblies.

7. Roll forming machine as claimed in claim 2, wherein the sliding support means includes a second set of rails mounted on said cart which register with the first set of rails on the fixed support when the cart is moved into a changing position adjacent a mill stand.

8. Roll forming machine as claimed in claim 7, each of said station supports are constituted by rails which register with the rails of the cart when the cart is moved into a changing position adjacent to one of the stations.

9. Method of changing components of a roll forming machine defining a material pass line therethrough comprising the steps of mounting said components for slidable movement relative to a fixed support in a direction transverse to the material pass line, moving a changing cart parallel to the material pass line into a position adjacent a component to be changed, removing said component from the fixed support by sliding said component to be changed off of the fixed support and onto the cart, and then sliding the component off of said cart and into a changing station on a changing fixture.

10. Method of changing components of a roll forming machine as claimed in claim 9, wherein said method includes the further steps of sliding a replacement component from another station of the changing fixture onto said cart, and then sliding the replacement component from said cart onto the fixed support.

11. Method of changing components of a roll forming machine as claimed in claim 10, wherein said method includes the steps of moving said cart to another component to be changed and then repeating the foregoing steps.

12. Method of changing components of a roll forming machine as claimed in claim 10, wherein said method includes the steps of mounting said fixture for movement in a direction parallel to the material pass line.

* * * * *